US012344424B2

(12) United States Patent
Fox

(10) Patent No.: US 12,344,424 B2
(45) Date of Patent: Jul. 1, 2025

(54) CASE-HANDLING DEVICE WITH FOLDING GUIDES

(71) Applicant: Signode Industrial Group LLC, Tampa, FL (US)

(72) Inventor: Bryce J. Fox, Honesdale, PA (US)

(73) Assignee: SIGNODE INDUSTRIAL GROUP LLC, Tampa, FL (US)

( * ) Notice: Subject to any disclaimer, the term of this patent is extended or adjusted under 35 U.S.C. 154(b) by 41 days.

(21) Appl. No.: 18/063,141

(22) Filed: Dec. 8, 2022

(65) Prior Publication Data

US 2023/0192334 A1 Jun. 22, 2023

Related U.S. Application Data

(60) Provisional application No. 63/265,623, filed on Dec. 17, 2021.

(51) Int. Cl.
*B65B 7/20* (2006.01)
*B65B 43/52* (2006.01)

(52) U.S. Cl.
CPC ..... *B65B 7/20* (2013.01); *B65B 43/52* (2013.01)

(58) Field of Classification Search
CPC ..... B65B 7/20; B65B 43/52
See application file for complete search history.

(56) References Cited

U.S. PATENT DOCUMENTS 3,108,515 A 10/1963 Stohlquist
3,374,604 A 3/1968 Roesner et al.
3,452,653 A * 7/1969 Berney ..... B65B 43/39 493/18
3,466,843 A * 9/1969 Mumper ..... B65B 51/067 53/76
3,468,101 A 9/1969 Vahle
3,662,516 A 5/1972 Wiseman
3,797,370 A 3/1974 Sawada
4,010,597 A * 3/1977 Nelson ..... B65B 7/20 53/376.5
4,079,577 A 3/1978 Ulrich et al.
4,160,406 A 7/1979 Nowacki
4,262,469 A * 4/1981 Ooms ..... B65B 7/20 53/76

(Continued)

FOREIGN PATENT DOCUMENTS

CH 329962 A 5/1958
FR 2407069 A1 5/1979

(Continued)

OTHER PUBLICATIONS

"Automatic folder gluer, stitcher line", Xiangxu, Corrface Consulting & Service Co., Ltd., found at cn.corrface.com/ucenter/details_page.aspx?id=40324&cid=40246, available before the priority date of this patent application.

(Continued)

*Primary Examiner* — Lucas E. A. Palmer
(74) *Attorney, Agent, or Firm* — Neal, Gerber & Eisenberg LLP

(57) ABSTRACT

Various embodiments of the present disclosure provide a case-handling device including movable folding guides positionable relative to a case to facilitate folding the case's upper major flaps outwardly along their respective fold lines before the case's upper minor flaps are closed.

20 Claims, 9 Drawing Sheets

(56) References Cited

U.S. PATENT DOCUMENTS

| | | | | | |
|---|---|---|---|---|---|
| 4,422,282 | A * | 12/1983 | Marchetti | B65B 7/20 | 493/183 |
| 4,524,560 | A * | 6/1985 | Goodman | B65B 7/20 | 53/377.3 |
| 4,562,686 | A * | 1/1986 | Focke | B65B 61/00 | 493/183 |
| 4,642,966 | A * | 2/1987 | Marchetti | B65B 7/20 | 493/183 |
| 4,781,786 | A * | 11/1988 | Lerner | B65B 51/067 | 156/468 |
| 4,955,177 | A * | 9/1990 | Lerner | B65B 7/20 | 493/183 |
| 5,035,683 | A | 7/1991 | Takeda et al. | | |
| 5,511,362 | A * | 4/1996 | Morita | B65B 51/067 | 493/183 |
| 5,772,568 | A * | 6/1998 | Chen | B31B 50/00 | 493/183 |
| 6,067,773 | A * | 5/2000 | Le | B65B 59/02 | 493/182 |
| 6,070,396 | A * | 6/2000 | Rinaldi | B65B 7/20 | 493/23 |
| 6,910,314 | B2 * | 6/2005 | Le | B65B 59/02 | 53/136.3 |
| 7,140,165 | B2 * | 11/2006 | Ventura | B65B 59/003 | 493/476 |
| 7,278,248 | B2 | 10/2007 | Vinh | | |
| 7,331,916 | B2 | 2/2008 | Fox | | |
| 7,383,864 | B2 * | 6/2008 | Hogerton | B65C 9/1869 | 156/542 |
| 7,571,588 | B2 | 8/2009 | Sambuca et al. | | |
| 7,886,503 | B2 * | 2/2011 | Chase | B65B 7/20 | 53/376.4 |
| 8,529,421 | B2 * | 9/2013 | Fallas | B65B 7/20 | 493/70 |
| 9,452,852 | B2 | 9/2016 | Sambuca | | |
| 10,597,179 | B2 | 3/2020 | Menta et al. | | |
| 11,273,939 | B2 | 3/2022 | Fox | | |
| 11,358,744 | B2 | 6/2022 | Menta et al. | | |
| 11,492,163 | B2 | 11/2022 | Menta et al. | | |
| 2002/0170271 | A1 * | 11/2002 | Pearce | B65B 43/54 | 53/238 |
| 2004/0068956 | A1 * | 4/2004 | Hartness | B65B 21/183 | 53/247 |
| 2004/0093829 | A1 * | 5/2004 | Marchetti | B65B 7/20 | 53/378.3 |
| 2004/0226268 | A1 * | 11/2004 | Vinh Le | B65B 59/02 | 53/76 |
| 2005/0235603 | A1 * | 10/2005 | Le | B65B 51/067 | 53/136.4 |
| 2013/0184135 | A1 | 7/2013 | Duer | | |
| 2017/0247129 | A1 * | 8/2017 | Menta | B65B 59/003 | |
| 2018/0141700 | A1 | 5/2018 | Ridgeway et al. | | |
| 2019/0193886 | A1 * | 6/2019 | Brizzi | B65B 59/005 | |
| 2019/0283914 | A1 | 9/2019 | Menta et al. | | |
| 2019/0283916 | A1 | 9/2019 | Menta et al. | | |
| 2019/0329515 | A1 | 10/2019 | Davis | | |
| 2020/0039671 | A1 | 2/2020 | Fox | | |
| 2020/0148400 | A1 | 5/2020 | Menta et al. | | |
| 2021/0009294 | A1 | 1/2021 | Menta et al. | | |
| 2021/0300611 | A1 | 9/2021 | Menta | | |
| 2022/0089308 | A1 | 3/2022 | Monti | | |

FOREIGN PATENT DOCUMENTS

| | | | |
|---|---|---|---|
| FR | 2511341 | A1 | 2/1983 |
| GB | 462279 | A | 3/1937 |
| GB | 549632 | A | 11/1942 |
| GB | 699260 | A | 11/1953 |
| GB | 1274670 | A | 5/1972 |
| WO | 2022217203 | A1 | 10/2022 |

OTHER PUBLICATIONS

"LD24 Case Sealer", Little David Love Shaw, found at https://www.youtube.com/watch?v=zUtiJ64WyH0, available before the priority date of this patent application.

"Extended European Search Report", from corresponding European Patent Application No. 22212473.7, May 25, 2023.

"Communication pursuant to Article 94(3) EPC", from corresponding European Patent Application No. 22212473.7, Nov. 27, 2024.

"Auto Flap Folder With Taping", SGCE Packaging Machines, found at https://www.youtube.com/results?search_query=auto+flap+folder+with+taping, Apr. 16, 2021.

"Automatic folder gluer, stitcher line", Xiangxu, Corrface Consulting & Service Co., Ltd., found at cn.corrface.com/ucenter/details_page.aspx?id=40324&cid=40246, available before the priority date of this patent application, Dec. 17, 2021.

"LD24 Case Sealer", Little David Love Shaw, found at https://www.youtube.com/watch?v=zUtiJ64WyHO, available before the priority date of this patent application, Dec. 17, 2021.

* cited by examiner

CASE-HANDLING DEVICE WITH FOLDING GUIDES

PRIORITY

This application claims priority to and the benefit of U.S. Provisional Patent Application No. 63/265,623, filed Dec. 17, 2021, the entire contents of which is incorporated herein by reference.

FIELD

The present disclosure relates to case-handling devices, and more particularly to case-handling devices with folding guides that facilitate proper case-flap folding.

BACKGROUND

Every day, companies around the world pack millions of items in cases (such as cases formed from corrugated) to prepare them for shipping. FIGS. 1A-1C show an example prior art case C. The case C includes a first major side wall SW1, a second major side wall SW2, a first minor side wall EW1, a second minor side wall EW2, a first upper major flap UMa1, a second upper major flap UMa2, a first upper minor flap UMi1, a second upper minor flap UMi2, a first lower major flap LMa1, a second lower major flap LMa2, a first lower minor flap LMi1 (numbered for ease of reference but not shown), and a second lower minor flap LMi2 (numbered for ease of reference but not shown).

The first and second minor side walls EW1 and EW2 are integrally connected to opposing side edges, respectfully, of the first major side wall SW1 and are separated from the first major side wall SW1 via vertical fold lines (such as creases or scores) F1 and F2, respectively. The first and second minor side walls EW1 and EW2 are also integrally connected to opposing side edges, respectfully, of the second major side wall SW2 and are separated from the second major side wall SW2 via vertical fold lines F3 and F4, respectively. Accordingly, the first and second minor side walls EW1 and EW2 and the first and second major side walls SW1 and SW2 are all integrally connected.

The first upper and lower major flaps UMa1 and LMa1 are integrally connected to the upper and lower edges, respectfully, of the first major side wall SW1 and separated from the first major side wall SW1 via horizontal fold lines F5 and F6, respectively. The second upper and lower major flaps UMa2 and LMa2 are integrally connected to the upper and lower edges, respectfully, of the second major side wall SW2 and separated from the second major side wall SW2 via horizontal fold lines F7 and F8, respectively. The first upper and lower minor flaps UMi1 and LMi1 are integrally connected to the upper and lower edges, respectfully, of the first minor side wall EW1 and separated from the first minor side wall EW1 via horizontal fold lines F9 and F10 (numbered for ease of reference but not shown), respectively. The second upper and lower minor flaps UMi2 and LMi2 are integrally connected to the upper and lower edges, respectfully, of the second minor side wall EW2 and separated from the second minor side wall EW2 via horizontal fold lines F11 and F12, respectively.

FIG. 1A shows the case C in a partially closed configuration in which the major and minor side walls are generally perpendicular to one another, the lower major and minor flaps are closed, and the upper major and minor flaps are open. More specifically, the lower minor flaps LMi1 and LMi2 are folded along the fold lines F10 and F12, respectively, such that they extend into the cavity formed by the major and minor side walls SW1, SW2, EW1, and EW2 and are generally perpendicular to the major and minor side walls, and the lower major flaps LMa1 and LMa2 are folded along the fold lines F6 and F8, respectively, such that they cover the lower minor flaps LMi1 and LMi2 and are generally perpendicular to the major and minor side walls. Since the upper major and minor flaps are open, the upper end of case C is open and ready to receive items (and if necessary, dunnage) before the upper major and minor flaps are closed (i.e., folded and taped shut).

To close the top of the case after product (and, if needed, dunnage) is loaded in the case C, first, the upper minor flaps UMi1 and UMi2 are folded inwardly (i.e., toward one another) along their respective fold lines F9 and F11. It's important that the upper major flaps UMa1 and UMa2 are folded outwardly at this point because if they're not they can block the upper minor flaps UMi1 and UMi2 from being folded inwardly or otherwise interfere with closing. Second, the upper major flaps UMa1 and UMa2 are folded inwardly (i.e., toward one another) along their respective fold lines F5 and F7. After being closed, the upper major flaps UMa1 and UMa2 are sealed via pressure-sensitive tape.

Case-handling devices, such as case erectors, case formers, and case sealers, partially or fully automate the flap-closing and case-sealing processes. The meteoric rise in e-commerce has led to faster throughput and cases made from less robust (and cheaper) material. Because of this, when the upper major flaps UMa1 and UMa2 are folded outwardly to make room for folding the upper minor flaps UMi1 and UMa2, known case-handling devices occasionally fail to fold them along their fold lines. Folding the upper major flaps above or below their respective fold lines deforms or damages the case, can jam the case-handling device, and can result in inadequate sealing of the upper major flaps, ultimately reducing the integrity of the case (and the product inside) during the transit process.

For instance, in one circumstance, an upper major flap can be folded above its fold line. FIG. 1B shows one example in which the upper major flap UMa1 is folded above its fold line F5. In this circumstance, it's likely that the upper major flap will be improperly closed as the case-folding process continues. In another such circumstance, an upper major flap can be folded below its fold line. FIG. 1C shows one example in which the upper major flap UMa1 is folded below its fold line F5. In this circumstance, it's likely that the upper major flap will be improperly closed as the case-folding process continues. The folding of the upper major flap can also result in a damaged corner, such as the partial separation of the side wall SW1 and the end wall EW2 along fold line F2 as shown in FIG. 1C.

SUMMARY

Various embodiments of the present disclosure provide a case-handling device including movable folding guides positionable relative to a case to facilitate folding the case's upper major flaps outwardly along their respective fold lines before the case's upper minor flaps are closed.

Various embodiments of the present disclosure provide a case-handling device including a support, spaced-apart first and second folding guides, wherein the first and second folding guides are vertically and laterally movable relative to the support, one or more actuators operably connected to the first and second folding guides and configured to vertically and laterally move the first and second folding guides, and a controller operably connected to the one or more actuators. The controller is configured to, when a case having open first and second upper major flaps and first and second upper minor flaps is between the first and second folding guides: control the one or more actuators to move the first folding guide to a position adjacent a first fold line separating an outer surface of a first major side wall of the case and the first upper major flap; and control the one or more actuators to move the second folding guide to a position adjacent a second fold line separating an outer surface of a second major side wall of the case and the second upper major flap.

Various embodiments of the present disclosure provide a method of operating a case-handling device. The method includes, when a case having open first and second upper major flaps and first and second upper minor flaps is between a first folding guide and a second folding guide: moving the first folding guide to a position adjacent a first fold line separating an outer surface of a first major side wall of the case and the first upper major flap, and moving the second folding guide to a position adjacent a second fold line separating an outer surface of a second major side wall of the case and the second upper major flap.

DETAILED DESCRIPTION

Figure 1A:
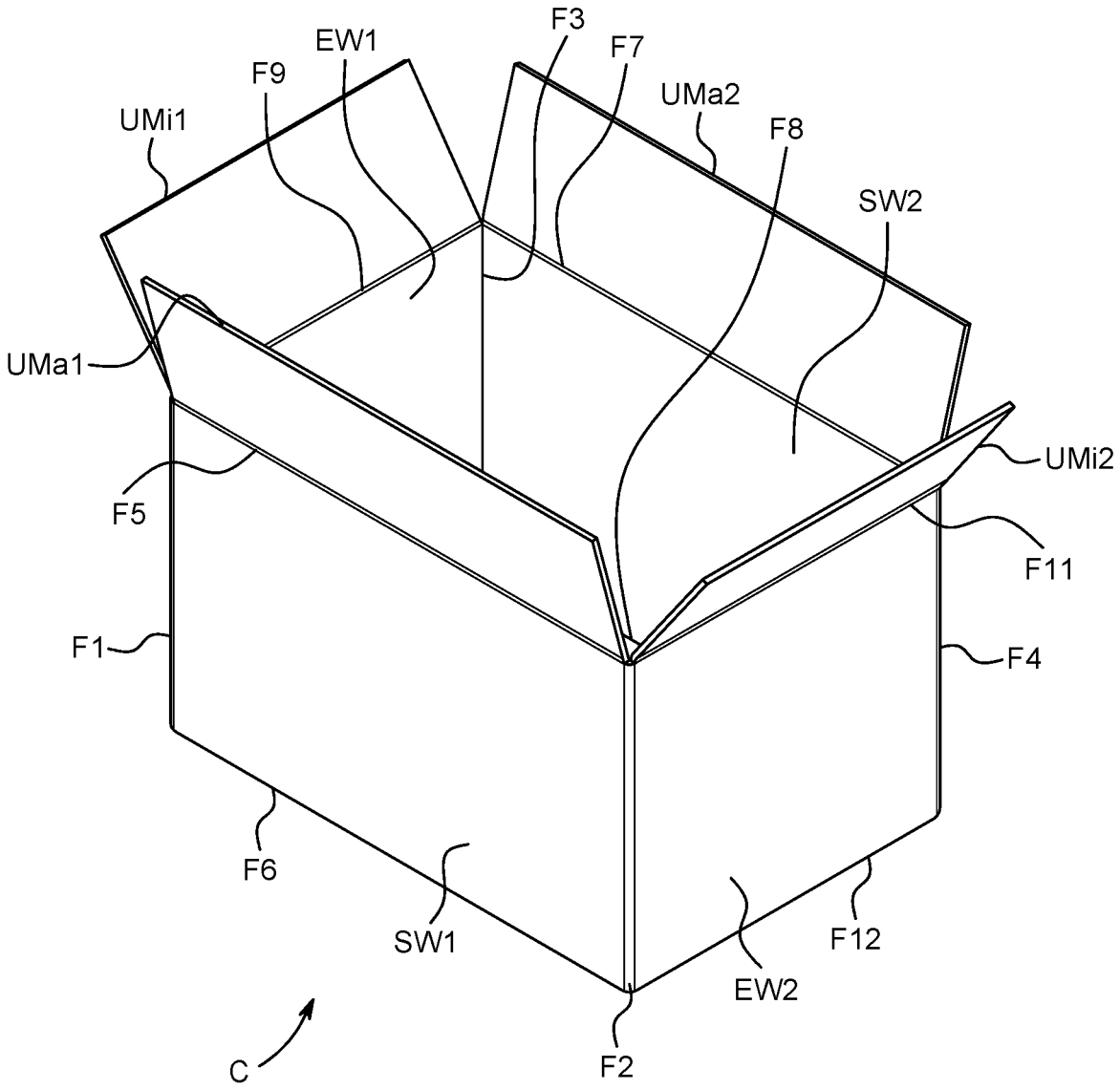
FIG. 1A PRIOR ART
FIG. 1A is a top perspective view of a prior art case having open upper major and minor flaps and closed lower major and minor flaps.
Figure 1B:
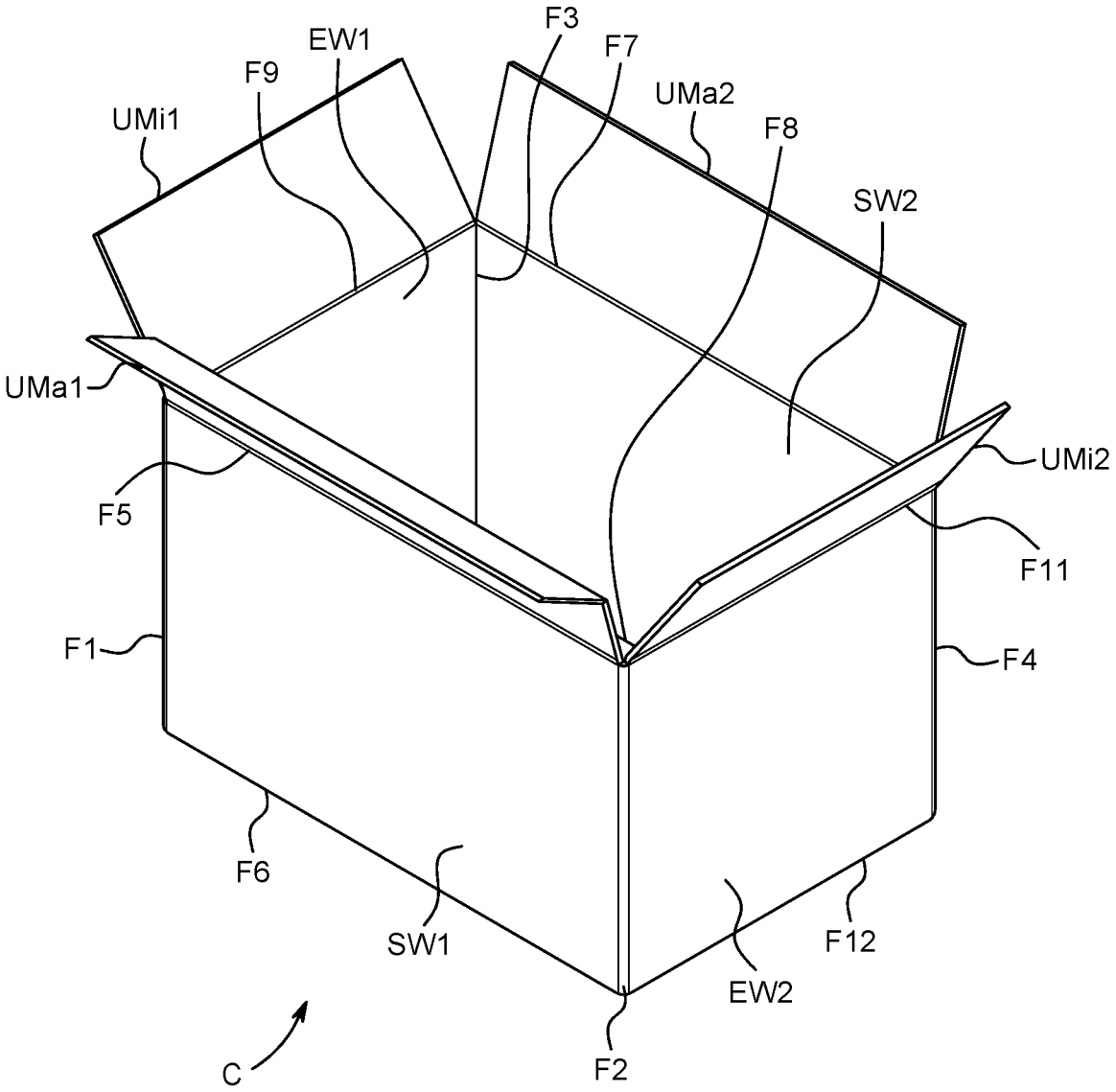
FIG. 1B PRIOR ART
FIG. 1B is a top perspective view of the case of FIG. 1A with one of the upper major flaps folded outwardly above its fold line.
Figure 1C:
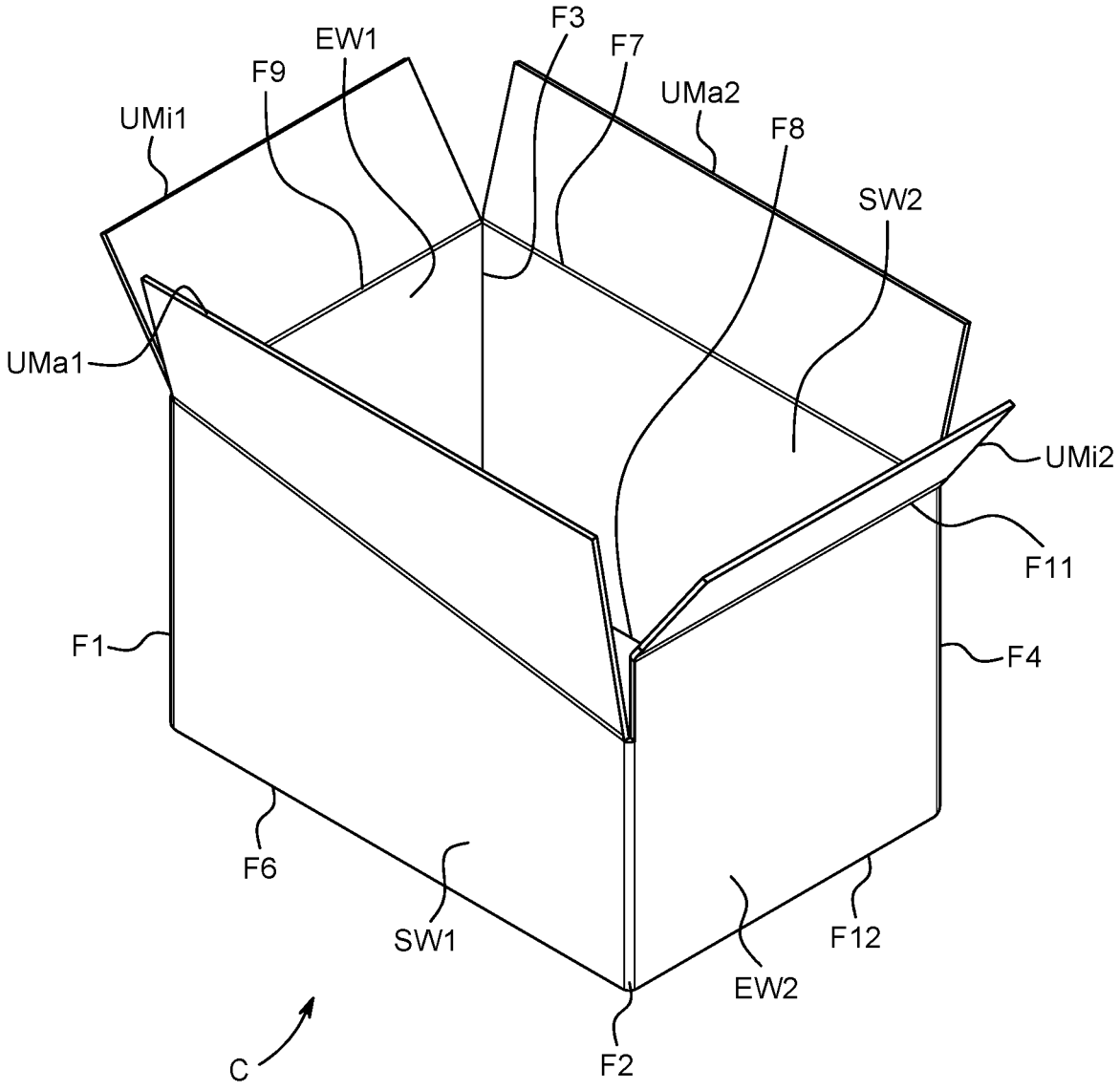
FIG. 1C PRIOR ART
FIG. 1C is a top perspective view of the case of FIG. 1A with one of the upper major flaps folded outwardly below its fold line.
Figure 2:
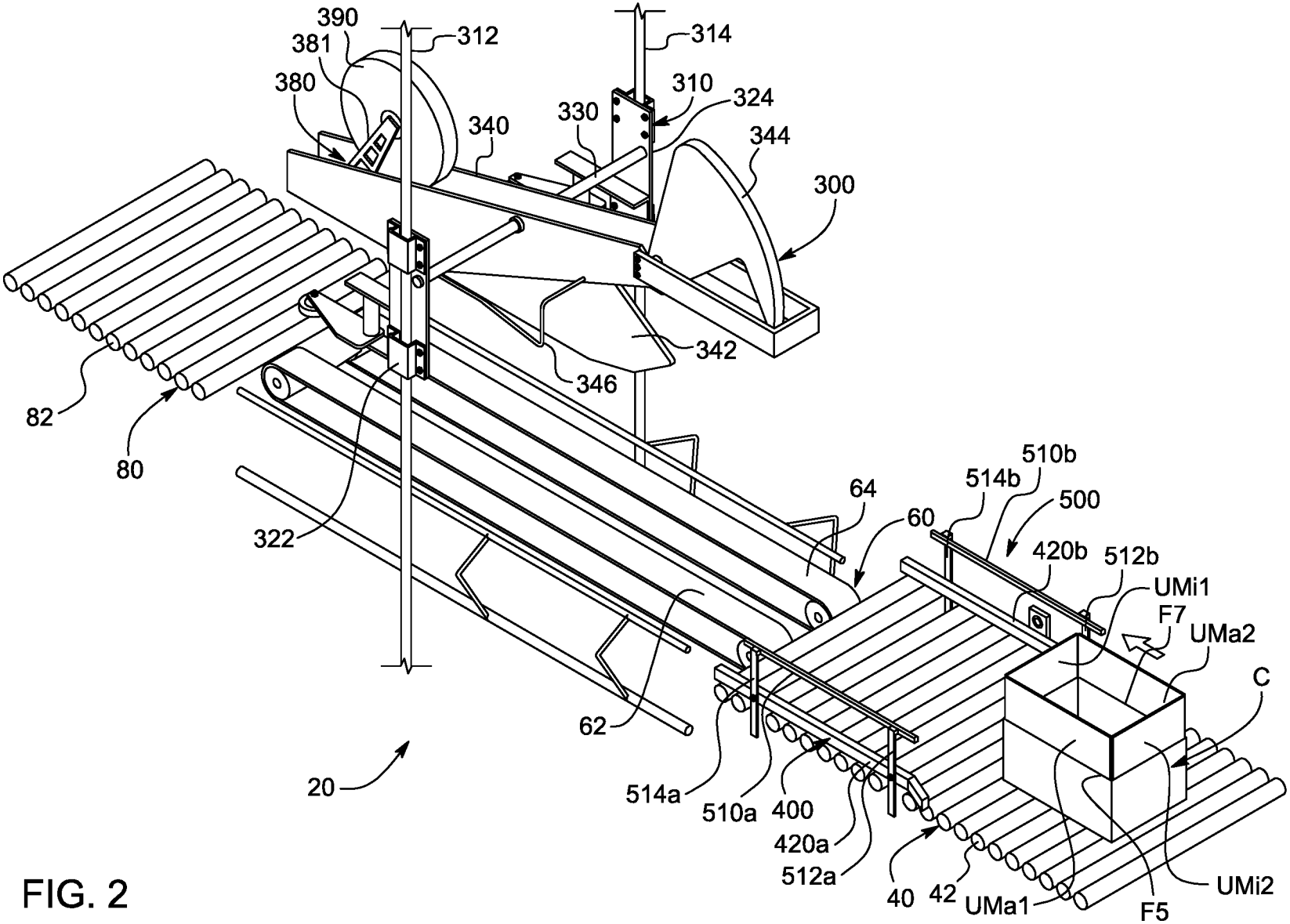
FIG. 2 is a perspective view of an example case-handling device of the present disclosure including two example folding guides of the present disclosure.
Figure 3:
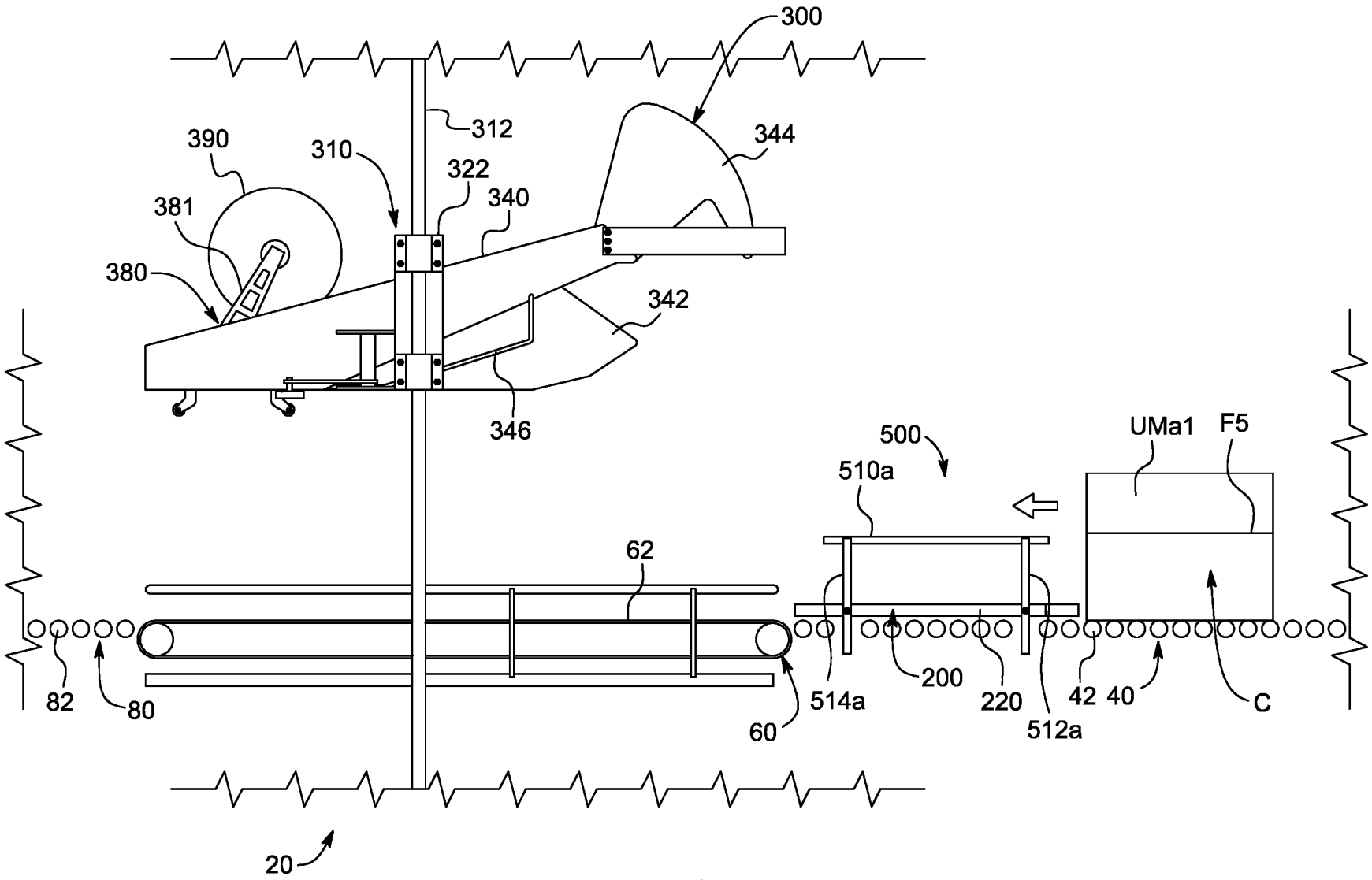
FIG. 3 is a side view of the case-handling device of FIG. 2.
Figure 4:
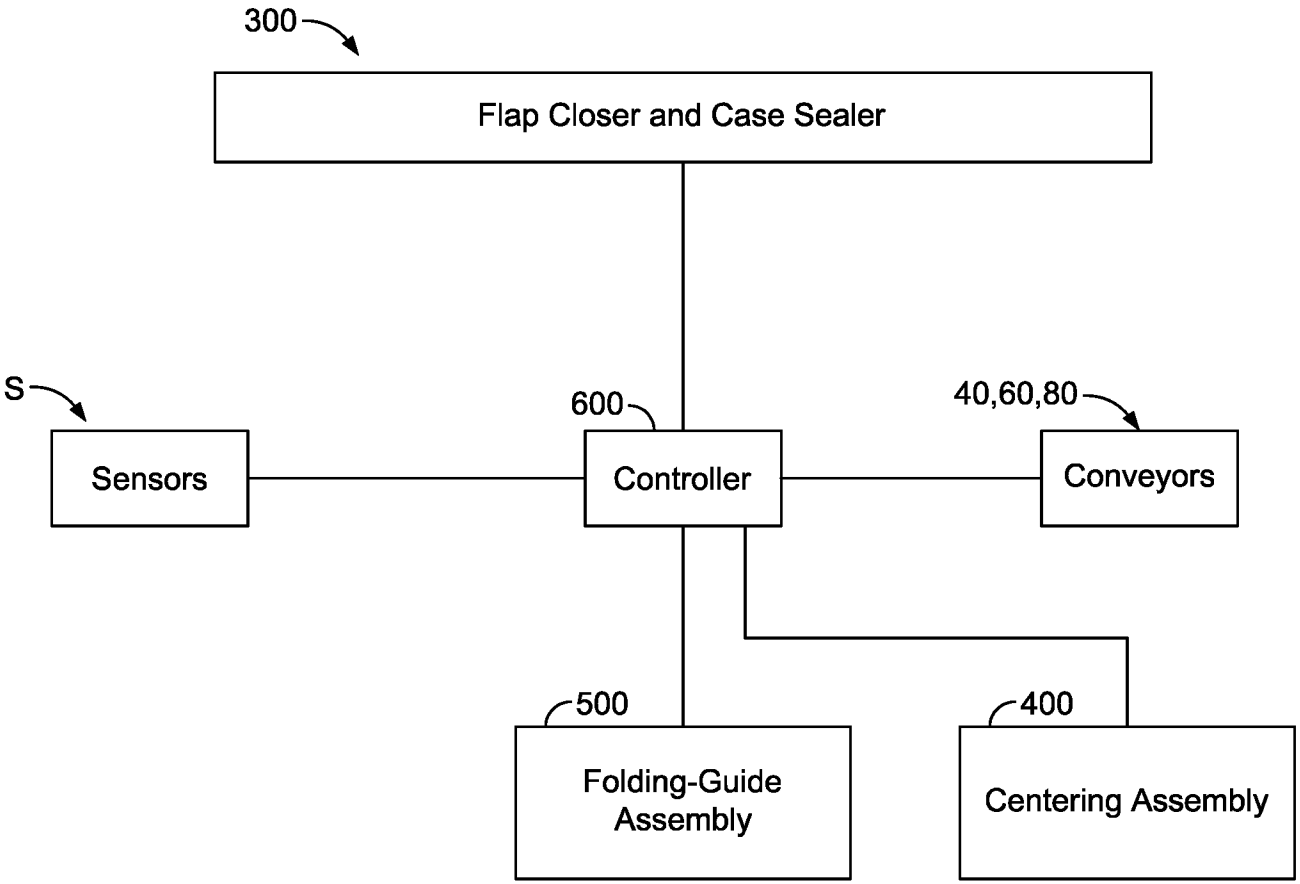
FIG. 4 is a block diagram showing certain components of the case-handling device of FIG. 2.
Figure 5:
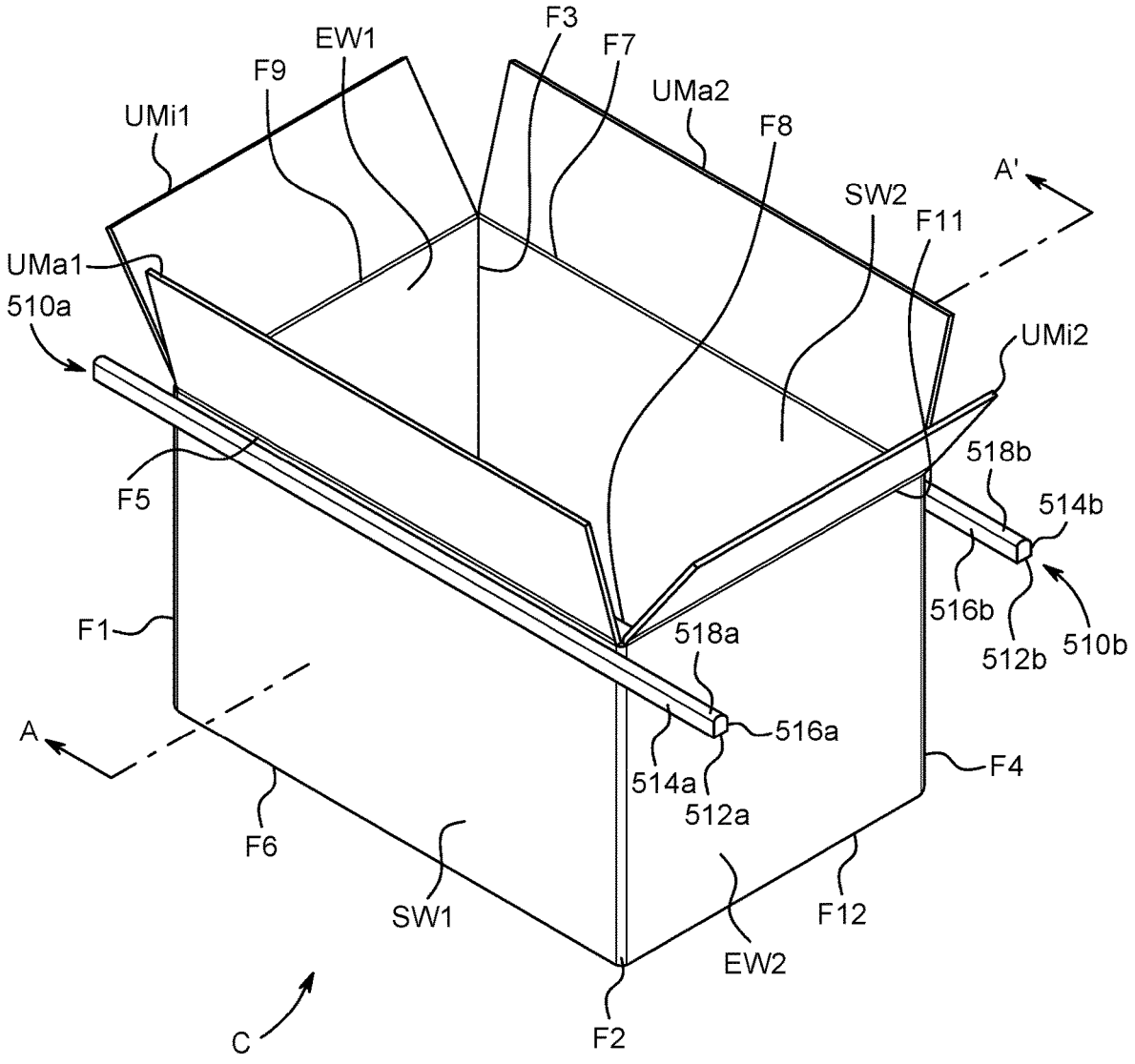
FIG. 5 is a top perspective view of the case of FIG. 1A and the folding guides of the case-handling device of FIG. 2 engaging the outer surfaces of the major side walls of the case slightly below the respective fold lines of the upper major flaps.

While the systems, devices, and methods described herein may be embodied in various forms, the drawings show, and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connection of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, etc., are not intended to be limited to direct mounting methods, but should be interpreted broadly to include indirect and operably coupled, mounted, connected, and like mounting methods. This specification is intended to be taken as a whole and interpreted in accordance with the principles of the present disclosure and as understood by one of ordinary skill in the art.

Various embodiments of the present disclosure provide a case-handling device including a folding-guide assembly including folding guides shaped, sized, and positionable to relative to a case to facilitate folding the case's upper major flaps outwardly along their respective fold lines before the case's upper minor flaps are closed.

FIGS. 2-8 show one example embodiment of a case-handling system 20 of the present disclosure and components thereof. The case-handling system 20 includes: an infeed conveyor 40, a central conveyor 60, an outfeed conveyor 80, a combined flap closer and case sealer 300, a centering assembly 400, a folding-guide assembly 500, a controller 600, and multiple sensors S.

The conveyors 40, 60, and 80 cooperate to move cases into, through, and out of the case-handling system 20. The infeed conveyor 40 is positioned upstream of the flap closer and case sealer 300, the outfeed conveyor 80 is positioned downstream of the flap closer and case sealer 300, and the central conveyor 60 is between the infeed and outfeed conveyors and below the flap closer and case sealer 300. The infeed and outfeed conveyors 40 and 80 each include a multiple rollers 42 and 82, respectively, that support the cases. The central conveyor 60 includes multiple parallel belts 62 and 64 that support the cases. The rollers 42 and 82 and the belts 62 and 64 are driven in tandem or independently by one or more drive assemblies (not shown) operated under the control of the controller 600.

The conveyor 40 is operable to deliver each case to a case-centering/flap-opening position adjacent the centering assembly 400 and the folding-guide assembly 500. After the upper major flaps of the case have been opened, the conveyor 40 is operable to move the case from that position to the conveyor 60. The conveyor 60 moves the case below and through the flap closer and case sealer 300 and delivers the case to the outfeed conveyor 80, at which point the flaps of the case have been closed and sealed. The conveyor 80 moves the case away from the case-handling system 20.

The centering assembly 400 is positioned upstream of the flap closer and case sealer 300 and along the infeed conveyor 40 and is operable to center cases on the infeed conveyor 40. The centering assembly 400 includes first and second centering arms 420*a* and 420*b* and a centering-arm actuator (not shown). The centering arms 420*a* and 420*b* are positioned on opposite sides of the infeed conveyor 40, extend generally parallel to a direction of travel of cases through the case-handling system 20 sealer 10, and are movable laterally inward (relative to the direction of travel) to laterally center the case on the infeed conveyor 40. The centering-arm actuator is operably connected to the first and second centering arms 420*a* and 420*b* (either directly or via suitable linkages) to move the centering arms between: (1) a rest configuration (FIG. 6) in which the centering arms are positioned at or near the lateral extents of the infeed conveyor 40 to enable a case to-be-sealed to be conveyed between centering arms; and (2) a centering configuration (not shown) in which the centering arms (after being moved toward one another) contact the case and center the case on the infeed conveyor 40. The controller 600 is operably connected to the centering-arm actuator to control the centering-arm actuator to move the centering arms 420*a* and 420*b* between the rest and centering configurations. The centering-arm actuator may be any suitable type of actuator, such as a motor or a pneumatic cylinder fed with pressurized gas and controlled by one or more valves.

The folding-guide assembly 500 is positioned upstream of the flap closer and case sealer 300, along the infeed conveyor 40, and adjacent the centering assembly 400 and is operable to facilitate folding the case's upper major flaps outwardly along their respective fold lines before the case's upper minor flaps are closed. The folding-guide assembly 500 includes: first and second folding guides 510*a* and 510, supports 512*a* and 514*a* connected to the first folding guide 510*a*, supports 512*b* and 514*b* connected to the second folding guide 510*b*, and one or more folding-guide actuators (not shown).

As best shown in FIGS. 5-8, the first folding guide 510*a* includes an elongated body having a lower surface 512*a*, an outer side surface 514*a*, a bracing surface 516*a*; and an upper surface 518*a*. Similarly, second first folding guide 510*b* includes an elongated body having a lower surface 512*b*, an outer side surface 514*b*, a bracing surface 516*b*; and an upper surface 518*b*. In this example embodiment, the upper surfaces 518*a* and 518*b* are curved while the other surfaces are planar. The folding guides 510*a* and 510*b* may have any suitable length, size, and shape. In various embodiments, the length of each folding guide may be shorter than, longer than, or the same length as the longest case that can be closed and sealed by the case-handling device 20.

In this example embodiment, the supports 512*a* and 514*a* are connected to the first centering arm 420*a*, and the supports 512*b* and 514*b* are connected to the second centering arm 420*b*. This results in the folding guides 510*a* and 510*b* extending generally parallel to a direction of travel of cases through the case-handling system 20 and above the centering arms 420*a* and 420*b*, respectively. The folding guides 510*a* and 510*b* are also movable laterally inward and outward (relative to the direction of travel) with the centering arms 420*a* and 420*b* as the centering arms move between their rest and centering configurations. The folding-guide actuators are operably connected to the first and second folding guides 510*a* and 510*b* (via the supports) to move the folding guides upward and downward relative to the centering arms 420*a* and 420*b*, the infeed conveyor 40, and the cases. The folding-guide actuators may be any suitable type of actuator, such as motors or pneumatic cylinders fed with pressurized gas and controlled by one or more valves. The controller 600 is operably connected to the folding-guide actuators to control the folding-guide actuators to move the folding guides. Accordingly, in this example embodiment, the folding guides 510*a* and 510*b* are movable relative to cases laterally inward and outward and upward and downward under the control of one or more actuators. In this example embodiment, the folding guides 510*a* and 510*b* are coupled or otherwise configured such that they simultaneously move vertically and laterally, though in other embodiments they are not coupled as such.

Figure 6:
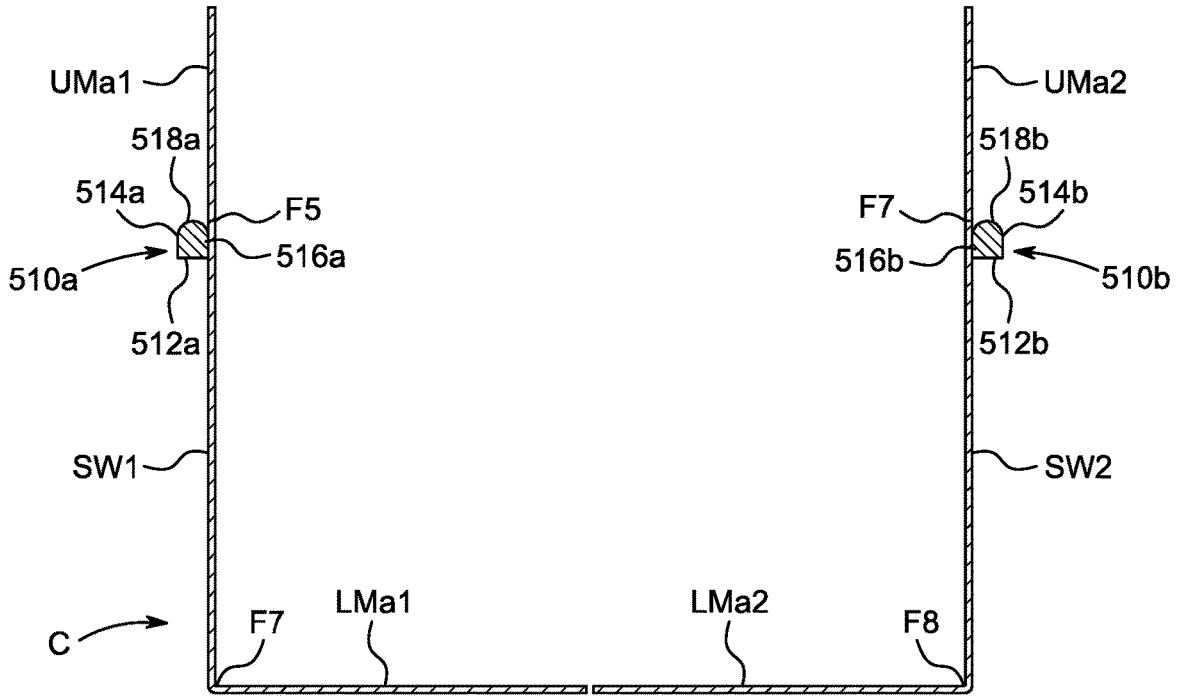
FIG. 6 is a cross-sectional view of the case and the two folding guides of FIG. 5 taken along line A-A' with the upper major flaps upright.
Figure 7:
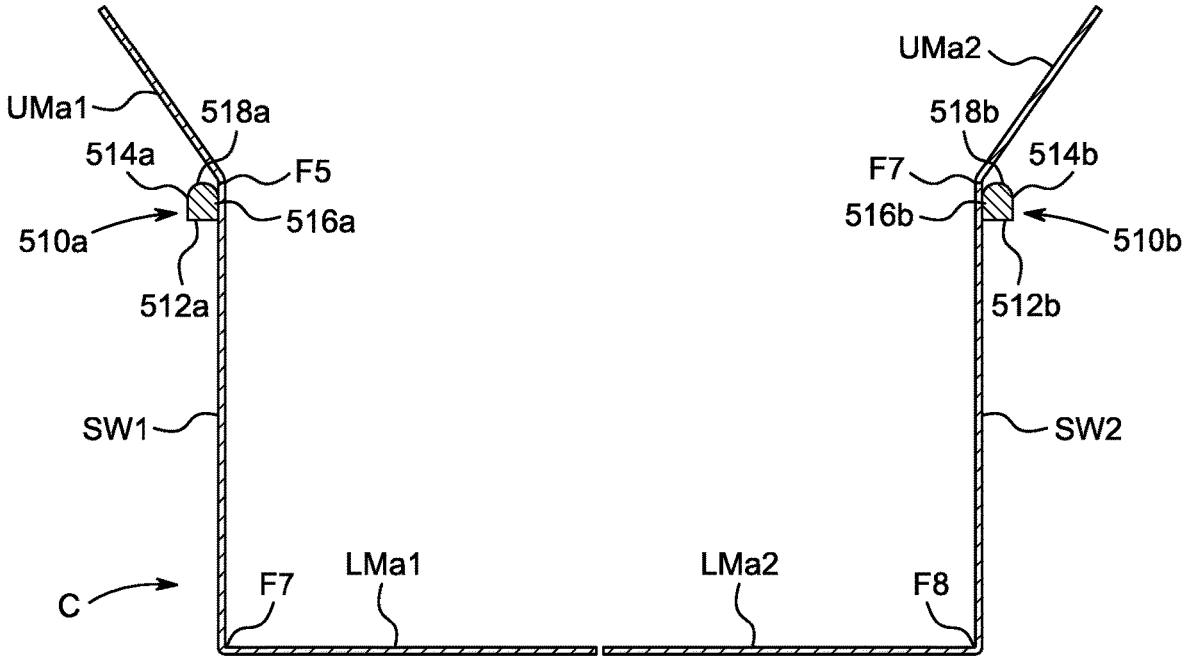
FIG. 7 is a cross-sectional view similar to FIG. 6 but with the upper major flaps folded outwardly.
Figure 8:
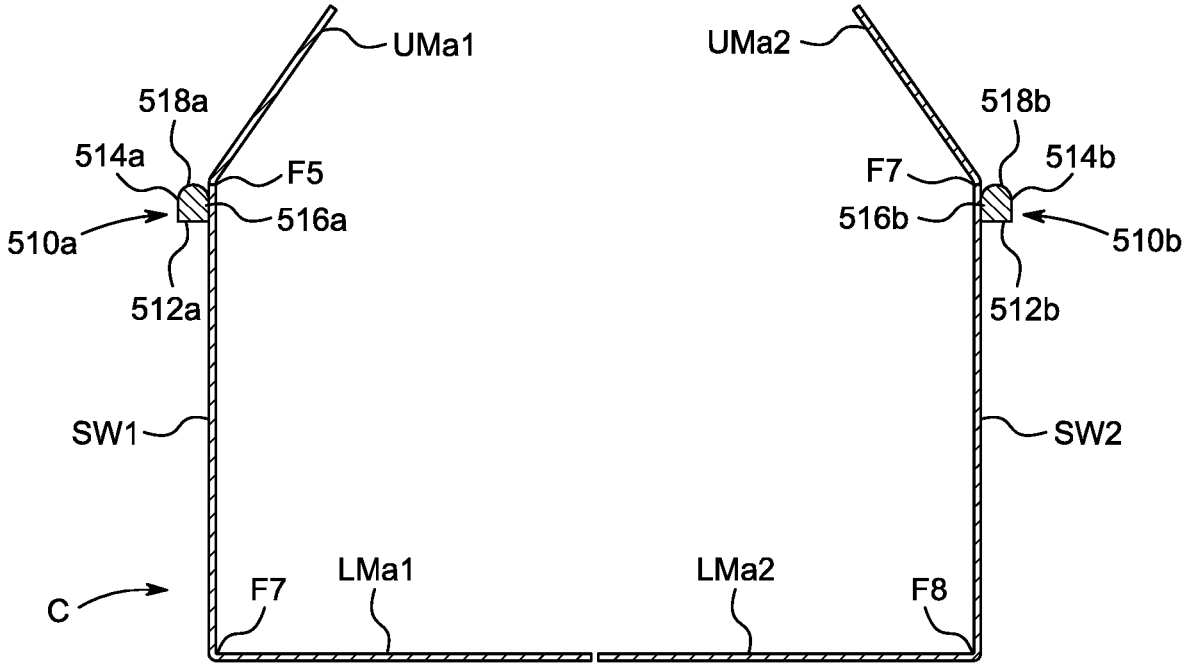
FIG. 8 is a cross-sectional similar to FIG. 6 but with the upper major flaps folded inwardly.

As described in more detail below, in operation, the controller 600 controls the appropriate actuators to move the folding guides 510*a* and 510*b* relative to a case C such that, as best shown in FIGS. 6-8, their respective bracing surfaces 516*a* and 516*b* engage (or in other embodiments, are slightly spaced-apart from) the respective outer surfaces of the major side walls SW1 and SW2 of the case C at or slightly below the upper fold lines F5 and F7. The combination of the elongated shape of the folding guides, their vertical position at or slightly below the fold lines, and their engagement with (or slight offset from) the major side walls results in the upper major flaps UMa1 and UMa2 folding outwardly (to make room for the upper minor flaps as shown in FIG. 7) or inwardly (after the minor flaps have been closed and as shown in FIG. 8) along their respective fold lines. Accordingly, in this example embodiment, the case C is braced from the side via engagement of the centering arms near the bottom of the major side walls and via engagement of the bracing surfaces of the folding guides near the top of the major side walls.

In other embodiments, the folding guides are not attached to and are vertically and laterally movable independently of the centering arms of the centering assembly. In these embodiments, the folding-guide actuators are operably connected to the first and second folding guides (via the supports) to move the folding guides upward and downward and laterally inward and outward relative to the centering arms, the infeed conveyor, and the cases, and the controller is operably connected to the folding-guide actuators to control the folding-guide actuators to move the folding guides.

In other embodiments, the shapes of one or more of the folding guide can vary such as, but not limited to being round, square, or triangular. In other embodiments, one or more of the folding guides include multiple connected or separate sections. In other embodiments, one or more of the folding guides can include one or more relatively small rollers or bearings.

The combined flap closer and case sealer 300 is operable to close the upper minor flaps of a case, then close the upper major flaps of the case, and then apply tape to the closed upper and lower major flaps. The combined flap closer and case sealer 300 includes a carriage 310 supported by and vertically movable relative to spaced-apart supports 312 and 314. The carriage 310 includes slide plates 322 and 324, a crossbar 330 attached to and extending between the slide plates 322 and 324, and an elongated support 340 attached to the crossbar 330. The slide plates 322 and 324 are slidably mounted to the supports 312 and 314. A carriage actuator (not shown) is operably connected to the carriage 310 and configured to move the carriage 310 vertically to adapt to cases of different heights. The controller 600 is operably connected to and configured to control the carriage actuator.

The support member 340 supports a stationary leading minor flap closer 342, a movable trailing minor flap closer 344, a first major flap closer 346, and a second major flap closer (not shown). More specifically, the stationary leading minor flap closer 342 extends downward from an underside of the support 340 and positioned, shaped, oriented, and otherwise is configured to engage the leading surface of the first upper minor flap UMi1 of a case C as central conveyor 60 moves the case C into contact with the stationary leading minor flap closer 342. Continued movement of the case C past the stationary leading minor flap closer 342 results in the first upper minor flap Until closing. The movable trailing minor flap closer 344 pivotably attached to the support 340 and configured to pivot downwardly (via a minor-flap-closer actuator (not shown) controlled by the controller 600) to engage and close the second upper minor flap UMi2 of the case C as the case moves under the combined flap closer and case sealer 300. The first and second major flap closers are positioned on opposite sides of the leading minor flap closer 342 and are positioned, shaped, oriented, and otherwise configured to engage and close the upper major flaps UMa1 and UMa2 of the case C as the central conveyor 60 moves the case C into contact with and past the major flap closers.

The flap closer and case sealer 300 also includes a tape applicator 380 that includes a tape cartridge 381 (partially shown) supporting a roll of tape 390. The tape applicator 380 is configured to apply tape from the roll 390 to the closed upper major flaps UMa1 and UMa2 and minor side walls of the case as the central conveyor 60 moves the case C beneath and past the tape cartridge 381.

The controller 600 controls, communicates with, and operates with the components of the case-handling device 20, including various actuators, drive assemblies, and sensors referenced above. The controller 600 is configured to control movement or operation of at least part of the conveyors, the combined flap closer and case sealer 300, the centering assembly 400, and the folding-guide assembly 500. The controller 600 can be any suitable type of controller (such as a programmable logic controller) that includes any suitable processing device(s) (such as a microprocessor, a microcontroller-based platform, an integrated circuit, or an application-specific integrated circuit) and any suitable memory device(s) (such as random-access memory, read-only memory, or flash memory). The memory device(s) stores instructions executable by the processing device(s) to control operation of the case-handling device 20.

In operation, the controller 600 controls the infeed conveyor 40 to move a case C toward the flap closer and case sealer 300. When the case C is between the centering arms 420*a* and 420*b* of the centering assembly 400 and between the folding guides 510*a* and 510*b* of the folding-guide assembly 500, one of the sensors S (such as a photocell) is triggered. This causes the controller 600 to: stop the infeed conveyor 40, move the centering arms 420*a* and 420*b* laterally inwardly to center the case C on the infeed conveyor 40, and move the folding guides 510*a* and 510*b* until their respective bracing surfaces 516*a* and 516*b* engage (or in other embodiments, are slightly spaced-apart from) the respective outer surfaces of the major side walls SW1 and SW2 of the case C at or slightly below the upper fold lines F5 and F7. In other embodiments, the controller 600 does not stop the movement of the case, and in such embodiments, the controller can change speed of the movement of the case or cause the movement of the case to remain constant. After another component of the case-handling system 20 or an operator folds the upper major flaps UMa1 and UMa2 of the case C outwardly, the case C is moved onto the central conveyor 60. The central conveyor 60 moves the case C beneath the flap closer and case sealer 300, which closes the upper minor and major flaps and tapes them shut, as explained above.

The controller 600 determines the proper position of the folding guides based on the size of the case (e.g., its height and width). In certain embodiments, one or more of the sensors S detect the height, width, and/or other measurements of the case upstream of the folding-guide assembly, and the controller determines where to position the folding guides based on those measurements. In other embodiments, the controller receives the measurements from another component in the packaging line. In further embodiments, the controller receives instructions as to where to position the folding guides from another component in the packaging line.

The present disclosure thus provides methods for sealing cases of different sizes using a single case-handling device that includes a side wall securing method that better ensures that the upper major flaps will be bent along the upper fold lines for those upper major flaps. In various embodiments, the side wall securing method includes: (a) positioning the case at a flap opening position; and (b) moving folding guides inwardly to engage opposite outer side surfaces of the case slightly below the respective major fold lines for the case to brace such sides of the case, such that the upper major flaps will be more likely to be opened along the respective fold lines for those upper major flaps. In various embodiments, the method further includes moving the folding guides upwardly or downwardly such that the engagement of the opposite outer side surfaces of the case is slightly below the respective major fold lines for the case. The method thus better ensures that the upper major flaps of the case are folded outwardly along the respective fold lines of the case before the upper minor flaps of the case are closed, and better ensures that the upper major flaps of the case can be subsequently folded inwardly along the respective fold lines.

The invention claimed is:

1. A case-handling device comprising:

a support;

spaced-apart first and second folding guides, wherein the first and second folding guides are vertically and laterally movable relative to the support;

one or more actuators operably connected to the first and second folding guides and configured to vertically and laterally move the first and second folding guides;

a flap closer downstream of the first and second folding guides and comprising:

one or more major flap closers configured to close the upper major flaps as the case moves past the one or more major flap closers; and one or more minor flap closers configured to close the upper minor flaps as the case moves past the one or more minor flap closers; and a controller operably connected to the one or more actuators and configured to, when a case having open first and second upper major flaps and first and second upper minor flaps is between the first and second folding guides:

control the one or more actuators to move the first folding guide to a position adjacent a first fold line separating an outer surface of a first major side wall of the case and the first upper major flap; and control the one or more actuators to move the second folding guide to a position adjacent a second fold line separating an outer surface of a second major side wall of the case and the second upper major flap.

2. The case-handling device of claim 1, wherein the controller is further configured to control the one or more actuators to move the first folding guide into engagement with the outer surface of the first major side wall of the case adjacent the first fold line and to move the second folding guide into engagement with the outer surface of the second major side wall of the case adjacent the second fold line.

3. The case-handling device of claim 2, wherein the first and second folding guides comprise planar first and second bracing surfaces, wherein the first and second bracing surfaces engage the outer surfaces of the first and second major side walls of the case.

4. The case-handling device of claim 1, wherein the first folding guide comprises a first elongated body and the second folding guide comprises a second elongated body.

5. The case-handling device of claim 4, wherein the first and second elongated bodies are each longer than a length of a longest case able to be processed by the case-handling device.

6. The case-handling device of claim 1, further comprising a centering assembly comprising spaced-apart first and second centering arms that are laterally movable relative to the support, wherein the one or more actuators are operably connected to the first and second centering arms and configured to laterally move the first and second centering arms.

7. The case-handling device of claim 6, wherein the first folding guide is connected to and laterally movable with the first centering arm, wherein the second folding guide is connected to and laterally movable with the second centering arm, wherein the first folding guide is vertically movable relative to the first centering arm, wherein the second folding guide is vertically movable relative to the second centering arm.

8. The case-handling device of claim 6, wherein the controller is further configured to, when the case is between the first and second folding guides, control the one or more actuators to move the first and second centering arms toward the case to engage and center the case on the support.

9. The case-handling device of claim 8, wherein the controller is further configured to control the one or more actuators to move the first folding guide into engagement with the outer surface of the first major side wall of the case adjacent the first fold line and to move the second folding guide into engagement with the outer surface of the second major side wall of the case adjacent the second fold line, wherein the first and second folding guides and the first and second centering arms are spaced apart and engage different portions of the case.

10. The case-handling device of claim 1, wherein the support comprises a conveyor.

11. The case-handling system of claim 1, further comprising a tape applicator downstream of the flap closer and configured to apply tape to the case as the case moves past the tape applicator to maintain the upper major and minor flaps closed.

12. The case-handling system of claim 1, wherein the one or more minor flap closers comprise:

a stationary leading minor flap closer shaped to engage and close the first upper minor flap as the case moves past the leading minor flap closer; and a trailing minor flap closer movable to engage and close the second upper minor flap as the case moves past the trailing minor flap closer.

13. The case-handling system of claim 12, wherein the trailing minor flap closer is upstream of the leading minor flap closer.

14. The case-handling system of claim 12, wherein the trailing minor flap closer is pivotable.

15. The case-handling system of claim 12, wherein the one or more major flap closers comprise:

a first major flap closer shaped to engage and close the first upper major flap as the case moves past the first major flap closer; and a second major flap closer shaped to engage and close the second upper major flap as the case moves past the second major flap closer.

16. The case-handling system of claim 15, further comprising a tape applicator downstream of the flap closer and configured to apply tape to the case as the case moves past the tape applicator to maintain the upper major and minor flaps closed.

17. The case-handling system of claim 1, wherein the controller is further configured to, after controlling the one or more actuators to (a) move the first folding guide to the position adjacent the first fold line and (b) move the second folding guide to the position adjacent the second fold line, control one or more conveyors to move the case past the flap closer.

18. The case-handling system of claim 17, further comprising a tape applicator downstream of the flap closer and configured to apply tape to the case as the case moves past the tape applicator to maintain the upper major and minor flaps closed, wherein the controller is further configured to move the case past the tape applicator after moving the case past the flap closer.

19. A case-handling device comprising:

a support;

spaced-apart first and second folding guides, wherein the first and second folding guides are vertically and laterally movable relative to the support;

one or more actuators operably connected to the first and second folding guides and configured to vertically and laterally move the first and second folding guides;

a flap closer downstream of the first and second folding guides and configured to close the upper major and upper minor flaps of the case as the case moves past the flap closer; and a controller operably connected to the one or more actuators and configured to, when a case having open first and second upper major flaps and first and second upper minor flaps is between the first and second folding guides:

(a) control the one or more actuators to move the first folding guide to a position adjacent a first fold line separating an outer surface of a first major side wall of the case and the first upper major flap;

(b) control the one or more actuators to move the second folding guide to a position adjacent a second fold line separating an outer surface of a second major side wall of the case and the second upper major flap; and (c) after (a) and (b), control one or more conveyors to move the case past the flap closer.

20. The case-handling system of claim 19, further comprising a tape applicator downstream of the flap closer and configured to apply tape to the case as the case moves past the tape applicator to maintain the upper major and minor flaps closed, wherein the controller is further configured to move the case past the tape applicator after moving the case past the flap closer.

* * * * *